United States Patent [19]

DelGuidice et al.

[11] Patent Number: 4,721,473

[45] Date of Patent: Jan. 26, 1988

[54] RETENTION FEATURE FOR PRINTED CIRCUIT BOARD MOUNTED CONNECTORS

[75] Inventors: Henry L. DelGuidice, Winston-Salem; Roger J. Flaherty, Greensboro, both of N.C.

[73] Assignee: AMP Incorporated, Harrisburg, Pa.

[21] Appl. No.: 932,072

[22] Filed: Nov. 17, 1986

[51] Int. Cl.[4] ..... H01R 9/09

[52] U.S. Cl. ..... 439/79; 439/554; 439/569; 411/508

[58] Field of Search ..... 339/17 R, 17 D, 17 C, 339/17 LC, 14 R, 126 R, 126 J, 126 RS, 128, 132 R, 132 B, 143 T, 193 R, 193 N, 193 P, 193 S, 193 VS, 217 S; 411/32, 33, 508–510; 439/79, 80, 92, 554

[56] References Cited

U.S. PATENT DOCUMENTS

| | | | |
|---|---|---|---|
| 2,814,024 | 11/1957 | Narozny | 339/193 P |
| 2,863,131 | 12/1958 | Carlzen et al. | 339/193 P |
| 2,980,880 | 4/1961 | Winkler et al. | 339/217 S |
| 3,760,335 | 9/1973 | Roberts | 339/99 R |
| 3,963,316 | 6/1976 | Williams | 339/17 C |
| 4,129,351 | 12/1978 | Sugimoto et al. | 339/17 LM |
| 4,469,387 | 9/1984 | McHugh | 339/42 |
| 4,639,066 | 1/1987 | Shimamiya et al. | 339/17 LC |

FOREIGN PATENT DOCUMENTS

| | | | |
|---|---|---|---|
| 472314 | 3/1951 | Canada | 339/193 R |

OTHER PUBLICATIONS

AMP Specification Sheet, No. 938, revised 7–72. Addendum–FIGS. 1 and 2, Champ Shielded Connector, AMP Inc.

*Primary Examiner*—Neil Abrams
*Attorney, Agent, or Firm*—Eric J. Groen

[57] ABSTRACT

An electrical connector which has a plurality of electrical contacts for interconnecting a plurality of data or communication lines is mountable to a printed circuit board and interconnectable to a plurality of electical traces thereon. The connector includes a front mating portion which is connectable to a matable connector, and a right angled portion, including a plurality of terminals, the right angled portion being mountable to a printed circuit board and the terminals being interconnectable to printed circuit board through holes. The connector further comprises a retention member which securely affixes the connector to the printed circuit board prior to soldering of the connector to the printed circuit board, and which provides a cylindrical soldering interface for mechanical stability of the connector to the printed circuit board.

19 Claims, 8 Drawing Figures

RETENTION FEATURE FOR PRINTED CIRCUIT BOARD MOUNTED CONNECTORS

BACKGROUND OF THE INVENTION

1. Field of the Invention

The subject invention relates to an electrical connector for mounting to a printed circuit board and for interconnecting to the electrical traces thereon, and more specifically to the retention feature which mounts the electrical connector to the printed circuit board.

2. Description of the Prior Art

There exists within the electronics industry electrical connectors which are right angled mounted to printed circuit boards, and for electrical interconnection to circuit traces on the printed circuit boards. One such problem involved in this industry relates to the mounting of the electrical connectors to the printed circuit boards. Typically, the electrical connectors are robotically inserted onto the printed circuit boards, and the assembly of the board and the connector is transferred to a wave soldering line where the electrical connector is soldered to the board. In addition to the terminals of the connector being interconnected to the printed circuit board, it is typical for a conductive retention feature to be commoned to the shield of the connector and then inserted into a through hole of the printed circuit board and soldered to a ground trace on the board.

In such an application where the retention feature is to common the shield to the printed circuit board, two considerations much be addressed. First, the retention feature must hold the connector squarely to the printed circuit board, in other words, the base of the connector must be held firmly to the printed circuit board such that the connector cannot rock on the printed circuit board. This assures that when the assembly of the printed circuit board and the connector are soldered to one another, the connector interface is parallel to the board. Typically, the datum line for electrical interconnections is the printed circuit board, thus a connector which is not properly aligned with the printed circuit board could actually preclude matability with the connector. For example, if the printed circuit board is interconnected to a right angled connector which is to mount within a personal computer, and the connector is to abut an outside wall of the chassis, if the connector is not properly aligned with the printed circuit board, when the printed circuit board is interconnected within the computer, the connector may not properly align with its intended connection port. This could result in a cable with a connector attached thereto which is not matable with the connector, or if it is matable, the connector must be forcibly aligned with the port which puts undue stresses on the printed circuit board connections.

Another aspect which is important for retention features is that they must provide adequate surface area for solderable interconnection thereto. When the retention feature projects through the printed circuit board through hole, the soldering of the retention member to the board provides the mechanical and electrical connection of the board to the connector. Increasing the surface area on the retention members to which the printed circuit board can be soldered, results in the strongest solder joint.

One such retention feature which is available is known as the split arrow and includes a flat stamping having members which are bent upwardly to form a flat locking feature which is parallel to the board. One problem with the split arrow approach is that since the locking member is flat or parallel to the board, the tolerance buildups between the connectors, boards and retention members can allow "play" between the connector housing and the board. This play can allow the connector to rock when the connector is placed on the board, such that when the board is soldered to connector, the connector and board are not parallel, resulting in the aforementioned problems.

The split arrow approach to board retention, as it is a flat stamping, allows little surface area for soldering thereto. The strength of a solder joint relates to the amount of solder deposited and the surface area of the solder interface. The solder interface on the split arrow retention feature is limited to the thickness of the flat metal stamping. When the mechanical stability of the connection system is limited to the strength of the solder joint, the electrical integrity of the interconnection can be jeopardized. For example, and again referring to the personal computer, if the connector and printed circuit board are placed at a port for exterior interconnection thereto, and the only mechanical stability is provided by the solder joints, the stepping on a cable which interconnects the printed circuit board mounted connector to the printer could disrupt the electrical integrity of the system.

SUMMARY OF THE INVENTION

The instant invention relates to an improved retention feature for printed circuit board mounting and to an electrical connector incorporating the same. The retention member is for use with an electrical connector which is printed circuit board mounted. The connector has an insulative housing with at least one hole through a base portion of the housing which lies adjacent to the printed circuit board. The depth of the hole is less than the thickness of the base portion. The retention member is a stamped and formed conductive member which has a first plate portion profiled to lie adjacent to the base portion of the connector housing, where the first plate portion has two legs extending downwardly therefrom. Each leg portion includes a first and second retaining means where the first set of retaining means is profiled to fit substantially adjacent to the end of the hole in the base portion, and the second set of retaining means is profiled to fit substantially adjacent to the end of a through hole on a mountable printed circuit board.

A shielded electrical connector which incorporates the retention member includes a front shielded portion having a front mating face profiled for receiving a matable connector and an opening from the rear of the shielded portion which extends to the front mating face. The shielded portion further includes commoning means which extend from the rear of the shielded portion. The shielded electrical connector further includes an insulative housing which includes a front portion and a base portion for mounting the connector to the printed circuit board, where the insulative housing is connectable to the front shielded portion. The base portion of the insulative housing has a mounting aperture means including a hole having a depth which is less than the thickness of the base. The electrical connector further includes a plurality of terminals which are mounted within the housing having four portions which extend toward the front mating face of the shielded portion for interconnection to a matable connector and right angled portions which extend downwardly beyond the base portion for interconnection to a printed circuit board. The leg portions of the retention member extend through the mounting aperture means to retain the connector to the printed circuit board while at the same time the retention member and the front shielded portion are cooperatively profiled such that the commoning means on the front shielded portion and the retention member are commoned together.

BRIEF DESCRIPTION OF THE DRAWINGS

FIG. 3A is a cross sectional view through lines 3—3 of FIG. 1, showing the printed circuit board exploded away from the connector.

FIG. 3B is a view similar to that of FIG. 3A showing the position of the retention member when the printed circuit board is of optimal thickness.

FIG. 3C is a view similar to that of FIG. 3A showing the position of the retention member when the printed circuit board is slightly oversized.

FIG. 3D is a view similar to that of FIG. 3A showing the position of the retention feature when the printed circuit board is slightly undersized.

DETAILED DESCRIPTION OF THE PREFERRED EMBODIMENT

Figure 1:
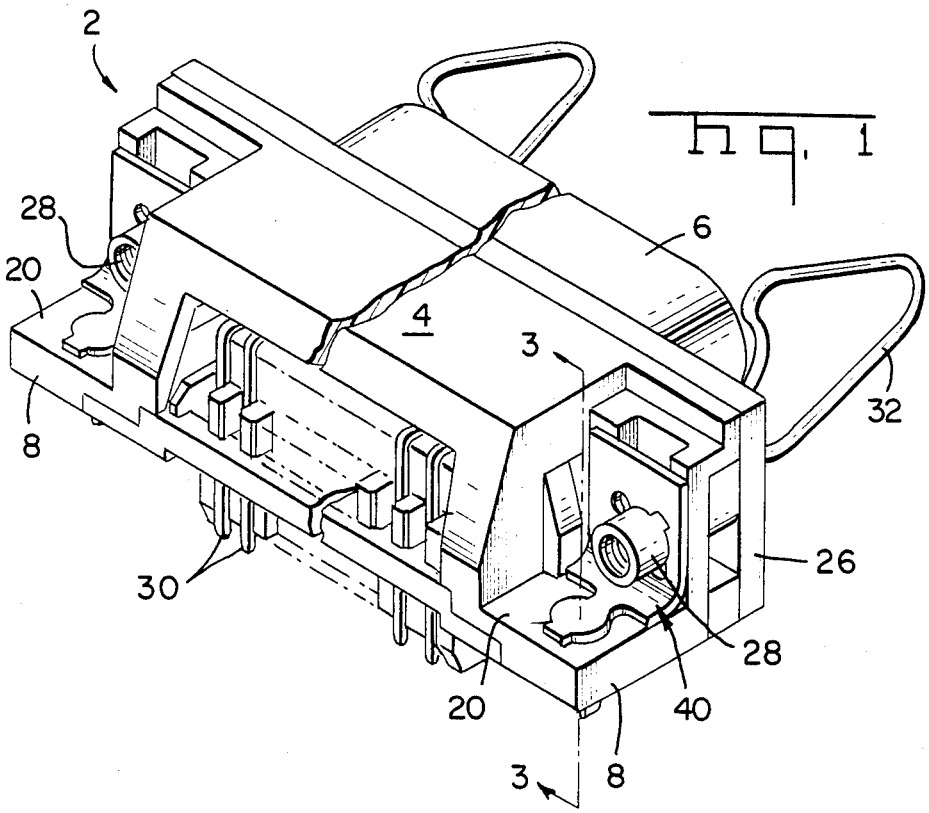
FIG. 1 is a perspective view of the connector and retention feature of the preferred embodiment of the instant invention.

Referring now to FIG. 1, the subject invention relates to an electrical connector for interconnecting to a printed circuit board and which is matable to a complementary connector of the type generally shown in U.S. Pat. No. 3,760,335, the disclosure of which is incorporated herein by reference. The electrical connector 2 is of the type shown in U.S. Pat. No. 4,469,387, the disclosure of which is incorporated herein by reference.

The electrical connector 2 comprises an insulative housing portion 4 and a front mating portion 6 which, in the preferred embodiment of the invention, is a shielded member. The preferred shield portion 6 is a die cast material, although a shielded portion manufactured from a drawn method could also be used. The shielded portion 6 includes a plate member 26 having a metallic boss 28 which extends through the insulative housing 4. Retention members 40 interferingly fit over the shielded boss members 28 to hold the housing member 4 and the shielded member 26 together. The connector 2 further comprises a plurality of terminals 30 having an end disposed for interconnection to a printed circuit board and another end disposed in the front shielded portion 6 for interconnection to a matable electrical connector. Bail clips 32 hold the matable electrical connector in a mating electrical condition.

Figure 2:
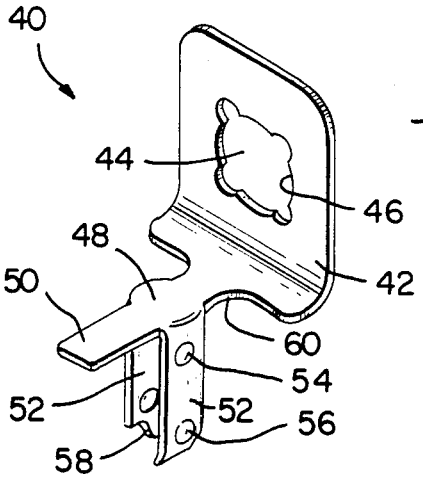
FIG. 2 is a perspective view of the retention member.
Figure 7A:
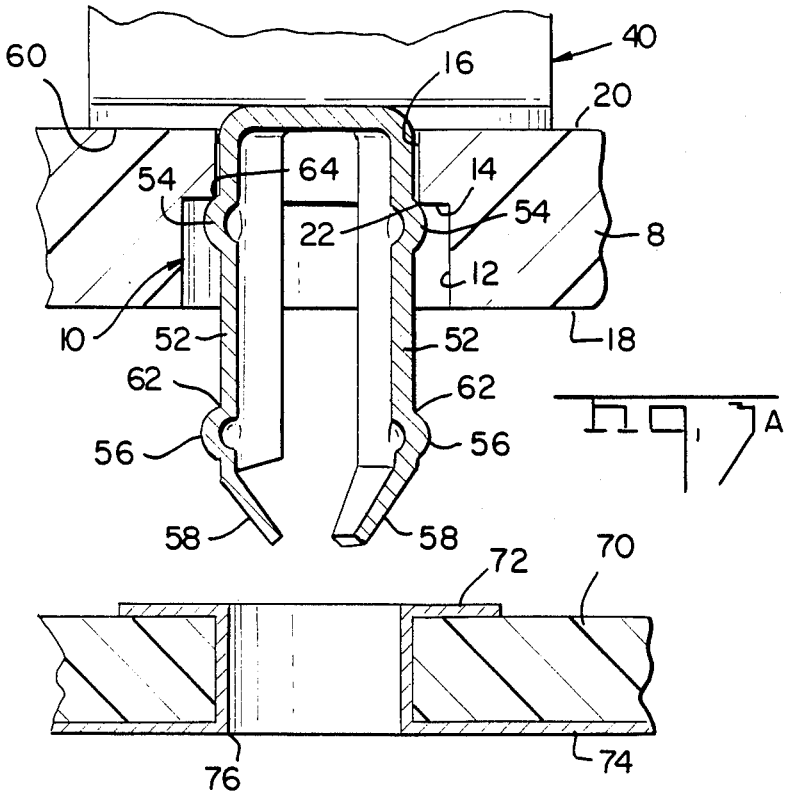
Figure 7B:
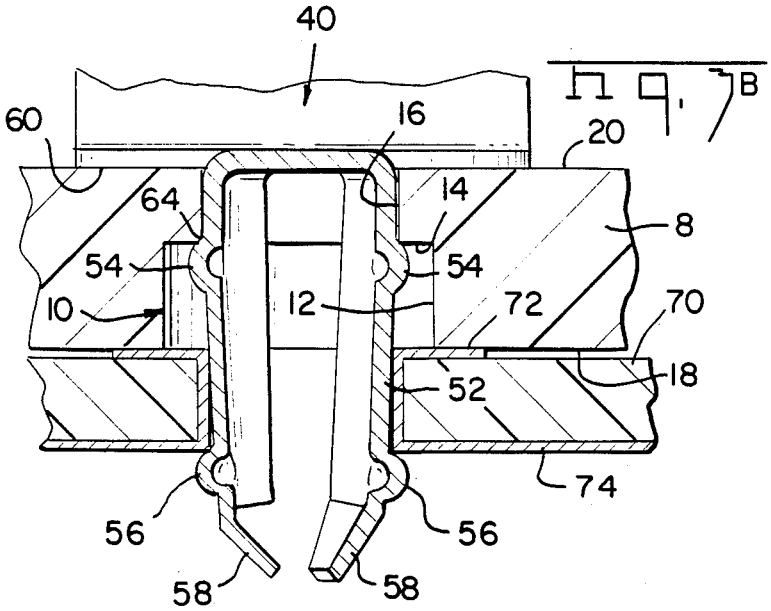
Figure 7C:
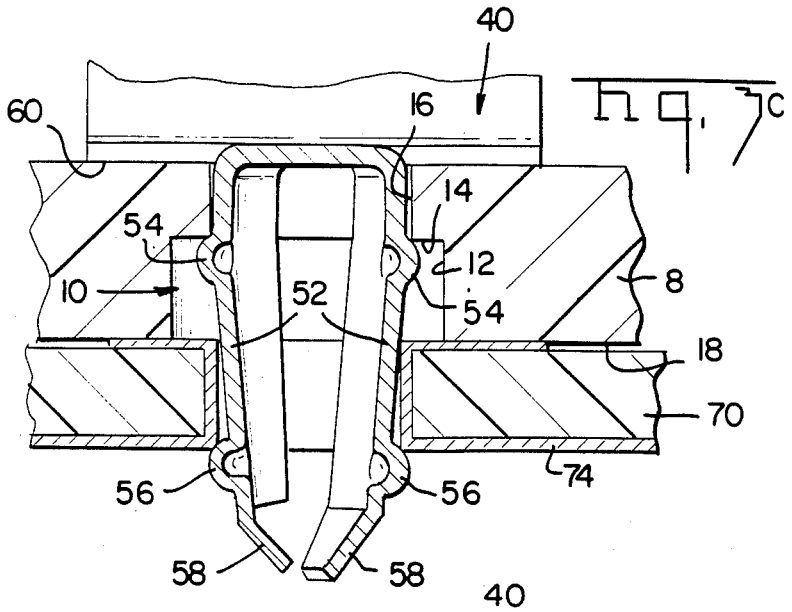
Figure 7D:
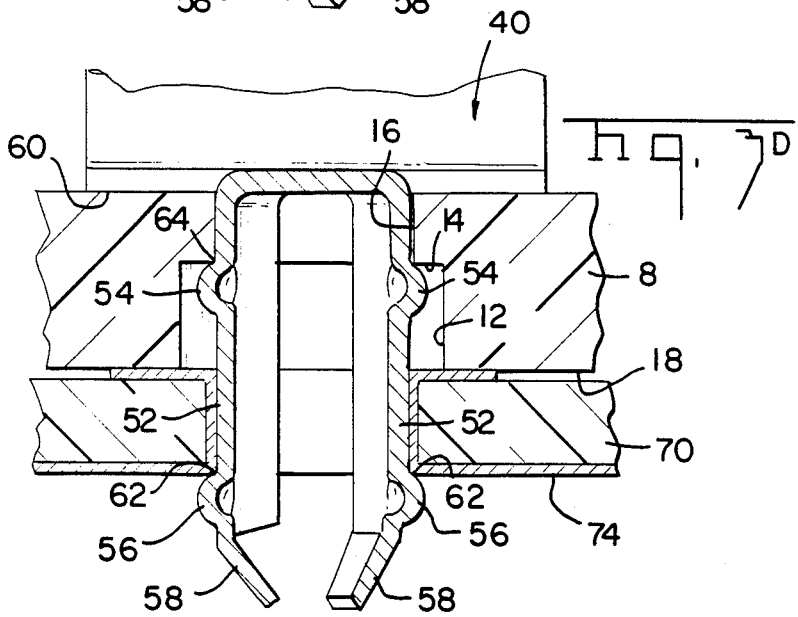

Referring now to FIG. 2, the retention member 40 is shown in better detail. Retention member 40 is a stamped and formed member originally in the plane of plate member 50. The retention member 40 includes a right angled plate member 42 formed upwardly of the original plane. The plate 42 includes an interfering spring retention member 44 having individual spring edges 46. The retention member 40 further includes two semi-cylindrical members 52 profiled to be received in a printed circuit through hole with an outward resilient bias. The preferred embodiment of the invention includes a retention member stamped and formed from 1050 steel and heat treated to stiffen the semi-cylindrical members 52, thereby increasing the spring constant of the members 52. The semi-cylindrical members 52 include first outwardly facing dimples 54 and a second set of outwardly facing dimples 56. As best shown in FIG. 2, extending from the bottom of the semi-cylindrical members 52 are two lead-in portions 58.

On each side of the connector housing 4 is located a mounting plate 8 (FIG. 1) for receiving the retention members 40. Referring now to FIG. 3A, the mounting plate 8 is shown in better detail. Each mounting plate 8 includes a counterbored hole 10 from the underside surface 18 of the plate 8. The counterbored hole 10 is defined by a first diameter 12 and a second diameter 16, which defines a downwardly facing shoulder 14. The retention members 40 are inserted through the upper surface 20 of the plate member 8 such that the first dimple 54 just clears the downwardly facing shoulder 14, as shown in FIG. 3A. As the manufacturing tolerances of the housing 4 and the retention member 40 are controllable, the distances between surfaces 14 and 20 of the mounting plate 8, and the distance between the underside surfaces 60 of the retention member and the corner 64 of the dimple 54 can be held, such that the optimum position for the retention member 40 is shown in FIG. 3A where the corner 22 of the counterbore 10 resides in the corner 64 of the first dimple 54.

The connector 2 is interconnectable to a printed circuit board 70 having a plated through hole 72 interconnected to a ground trace 74 as shown in FIG. 3A. The height of the plate through holes 72 cannot be closely toleranced however, and the height of most printed circuit board through holes varies from plus to minus 0.005 inches. In an attempt to retain the connectors to the printed circuit boards given any variance in printed circuit through hole thickness, the second set of dimples is controlled such that the optimum condition, that is where the printed circuit board thickness is plus 0.000 inches and minus 0.000 inches, the corner 76 of the plated through hole is slightly below the corner 62 of the dimples 56, as best shown in FIG. 3B. Therefore, when the thickness of the plated through hole or the printed circuit board 70 decreases to minus 0.005 inches the corner 76 of the plated through hole will be in the corner 62 of the dimples 56, as shown in FIG. 3D. If the thickness of the printed circuit board and the plated through hole increases to the plus 0.005 inch dimension, the vertical distance from the corner 76 of the plated through hole with respect to the corner 62 of the dimples 56 will be approximately 0.010 inches, however the corner will still reside on the dimple above the apex of the dimple 56.

Thus, irrespective of the variance in printed circuit board thickness, the resultant resilient force from the spring biased retention members 52 will still include an upward component applied to the printed circuit board through hole 72 from the underside, clamping the printed circuit board 70 and the under surface 18 of the housing plate 8 together. This is especially important when using a die cast shielded portion as the connector tends to be "nose heavy." This is also extremely important when the connector and printed circuit board assembly is robotically transferred to a soldering line, where in the transferring, the connector could be disengaged from the printed circuit board.

Figure 4:
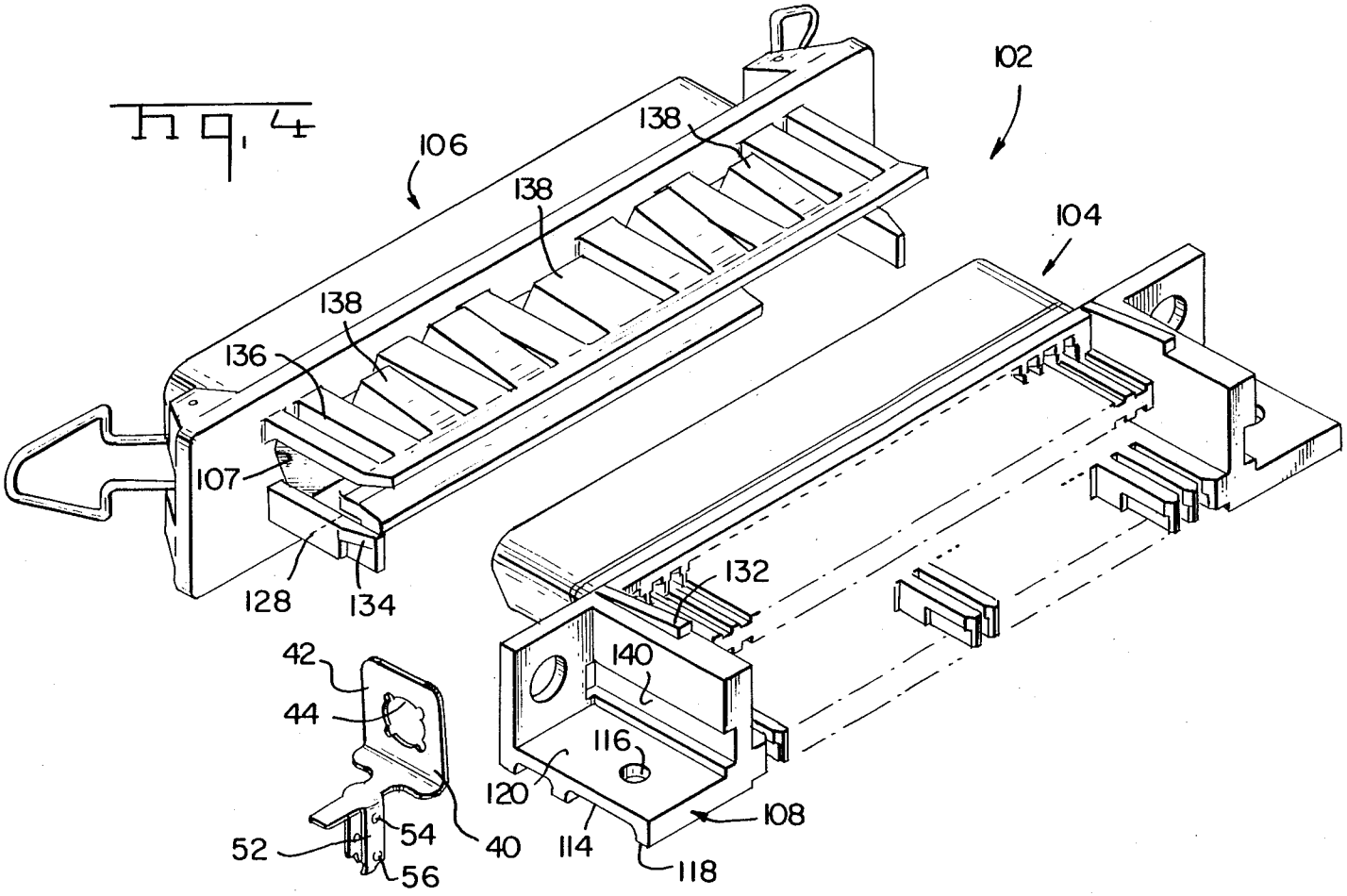
FIG. 4 is a perspective view of a second connector utilizing the retention member.

In order to reduce the insertion force of the retention members 40 into the printed circuit board through holes 72, as shown in FIG. 4, each leg member 52 includes an inwardly formed foot portion 58. The inwardly shaped foot portion 58 in combination with the spherically shaped dimples 56 reduces the insertion force of the retention members into the printed circuit board. Furthermore, the spherically shaped dimples 56 prevent scuffing or scratching the plated through hole 72 while it is being inserted. Furthermore, if prior to the soldering of the connector to the printed circuit board 70, the connector must be removed, the spherically shaped dimples 56 allow the easy removal of the connector from the printed circuit board, without degrading the electrical characteristics of the plated through hole 72.

In the first embodiment of the electrical connector, the shield portion 6 includes a conuctive post 28 extending rearwardly from the conductive plate 26. The conductive post extends through the housing portion 4 such that the spring member 44 (FIG. 2) overlies the conductive post and locks the shielded portion 6 and the housing portion 4 together. When the connector 2 is mounted to a printed circuit board in one of the configurations shown in FIGS. 3B–3D, the extending leg portions extend through the through hole to dispose the extending leg 52 in registration with the through hole 72 to common the shield 6 to the ground trace 74.

After the connector 2 is placed on the printed circuit board 70, the connector and board as an assenbly is transferred to a wave soldering line where the connector 2 and board 70 are soldered together. The larger the interface of the retention member 40 for soldering thereto, the stronger the solder joint. As shown in FIG. 2, the retention members 40 include semi-cylindrical portions 52 which, when inserted into the printed circuit board through hole 72, give the maximum amount of surface area to which the solder can adhere. When the retention member 40 is inserted through the printed circuit board through hole 72, as designed, the solder interface on the retention legs 52 is close to 180°.

Figure 5:
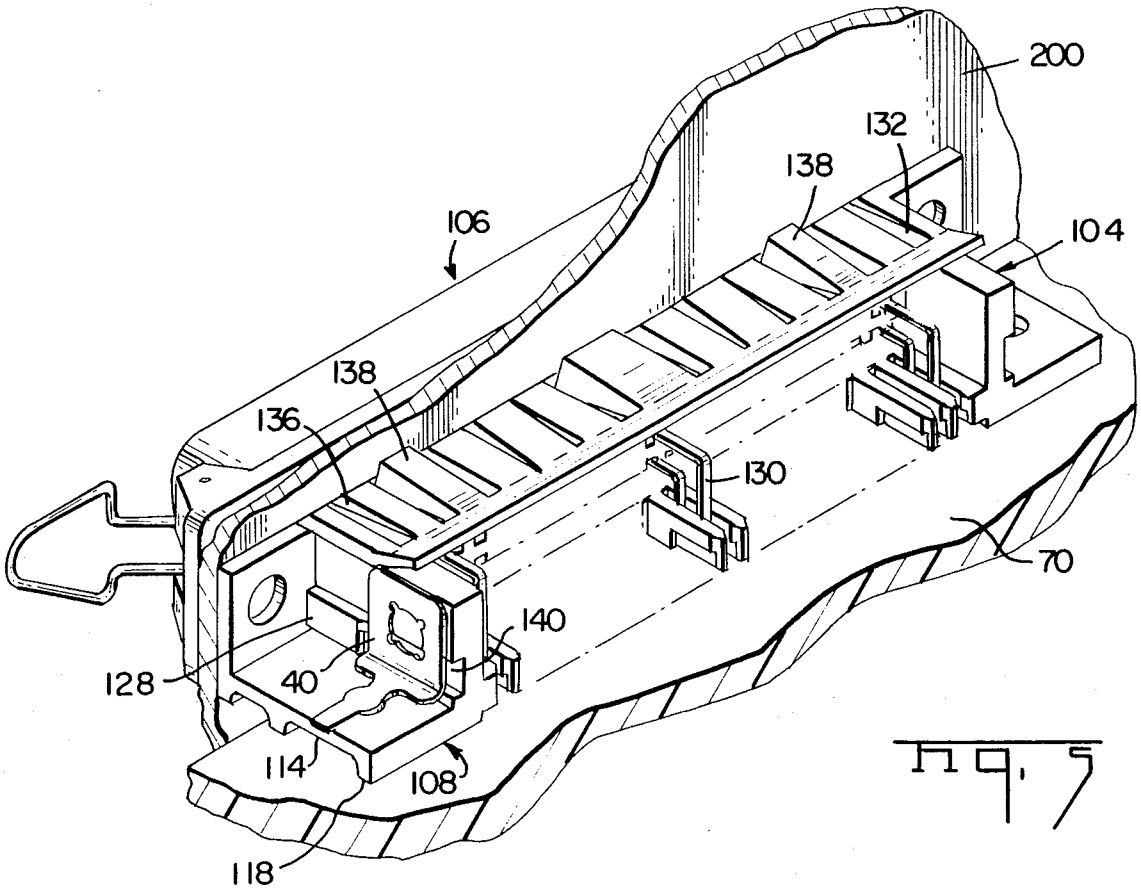
FIG. 5 is a perspective view of the assembled connector of FIG. 4.

As shown in FIG. 4, the retention member 40 can also be used on a panel mounted electrical connector 102 which is more fully described in co-pending application Ser. No. 932,073, filed concurrently herewith, the disclosure of which is incorporated herein by reference. The panel mount connector 102 comprises a forward matable portion 106 which is mountable to the outside of a panel 200 (FIG. 5), such as a chassis of a personal computer. The panel mount portion 106 includes resilient latches 138 to retain the panel mount portion 106 to the panel 200, as shown in FIG. 5. The connector portion 104 is insertable from the opposite side of the panel 200 into an opening 107 and is held fixed against the back side of the panel 200 by means of latches 132 engaging in channels 136. As it is desirable to remove the connector portion 104 from the panel mount portion 106, while maintaining the panel mount portion 106 in place, it is not desirable to use the spring member 44 as used in the previous embodiment, that is to lock the shielded portion and the housing portion together. It still is, however, desirable to common the shielded panel mount portion 106 to the ground trace 74 via the retention member 40. As shown in FIGS. 4 and 5, the plate portion 42 of the retention member 40 is disposed to abut a channel 140 in the sides of the housing. Extending from the back side of the panel mount portion 106 are two commoning arms 128 having lead-in surfaces 132. The preferred embodiment of the connector 102 comprises a plated plastic shielded portion 106 and an insulative member 104. Thus as the connector portion 104 and the panel mount portion 106 are assembled, as shown in FIG. 5, the conductive commoning arms 128 are disposed in channels 140 and are resiliently biased against the plate portion 42 of the retention member 40. In this manner, the forward shielded portion can be grounded to the ground trace on the printed circuit board. The plate member 108 of the housing portion 104 is similarly configured to the embodiment shown in FIGS. 1 through 4 such that the retention member 40 is insertable through the aperture 116 in the plate 108 and the first dimple 54 resides just below the surface 114 of the plate member 108. Surface 118 of the plate member 108 is similarly configured to the first embodiment such that the dimples 56 accommodate the printed circuit board as in FIGS. 3A through 3D.

The description of the invention was made with respect to specific references to the Figures, but should not be taken to limit the claims which follow.

What is claimed is:

1. A retention member for retaining a shielded electrical connector to a printed circuit board and for commoning said shielded connector to a ground trace on said printed circuit board, the connector having an insulative housing having a base portion which is mountable to the printed circuit board and a front face portion which is perpendicular to the base portion, the insulative housing having at least one hole through the base portion of the housing, the depth of said at least one hole being less than the thickness of said base portion, the electrical connector further comprising a front shielded portion which includes at least one commoning post extending rearwardly through at least one aperture in the front face portion of the insulative housing, the retention member comprising:

a stamped and formed conductive member having a first plate portion which is profiled to lie adjacent to the upper surface of the base portion of said connector housing, said first plate portion having two legs extending downwardly therefrom, each said leg portion having a first and second retaining means, said first set of retaining means being profiled to fit substantially adjacent to the lower end of the hole in the base portion, and said second set of retaining means being profiled to fit substantially adjacent to the lower end of a through hole on said printed circuit board, and a second plate portion profiled to overlie the aperture from the rear thereof, said second plate portion include means to retain the commoning post and the second plate portion together, thereby affixing the shielded portion and the insulative housing together and commoning the shielded portion to a ground trace on the printed circuit board adjacent to the throughhole.

2. The retention member of claim 1 wherein the extending legs are semi-cylindrically formed to face each other and form a substantially cylindrial configuration.

3. The retention member of claim 2 wherein the extending legs further comprise inwardly formed lead in sections which extend from ends of the legs.

4. The retention member of claim 1 wherein the retention means are outwardly formed deformations in the extending legs having an arcuate cross section.

5. The retention member of claim 4 wherein the deformations are dimple shaped.

6. The retention member of claim 4 wherein the arcuately shaped deformations define upper and lower corners at the intersection of the deformation with the extending leg, and an apex at the furthermost deformed point.

7. The retention member of claim 6 wherein the second set arcuately shaped deformations are profiled such that if the board is undersized the end of the printed circuit board through hole is located at the upper corner of the arcuately shaped deformations.

8. The retention member of claim 6 wherein the second said arcuately shaped deformations are profiled such that if the printed circuit board is nominally sized or over sized, the end of the printed circuit board through hole is below the upper corner of the deformation but above the apex of the deformation.

9. The retention member of claim 1 wherein the retention member is heat treated to increase the spring constant of the extending legs thereby biasing the extending legs against the through hole on a matable printed circuit board.

10. A shielded electrical connector for mounting to a printed circuit board, interconnecting a plurality of electrical terminals in the connector to a plurality of electrical traces on the printed circuit board, the connector comprising:

a front shielded portion of a conductive material, the front shielded portion having a front mating face profiled for receiving a matable connector, an opening from the rear of the shielded portion which extends to the front mating face, and commoning posts extending from the rear of the shielded portion;

an insulative housing comprising a front portion and a base portion for mounting the connector to the printed circuit board, the front portion including apertures therethrough for receiving the conductive posts of the front shielded portion, the base portion having a mounting aperture means therethrough including a hole having a depth which is less than the thickness of the base;

a plurality of terminals mounted within said housing having forward portions which extend towards the front mating face of the shielded portion for interconnection to a matable connector and right angled portions which extend downwardly beyond the base portion for interconnection to a printed circuit board;

at least one retention member for retaining the front shielded portion to the insulative housing and for retaining the electrical connector to a printed circuit board, the retention member comprising a first plate means lying substantially adjacent to the base means and a second plate means which upstands from the first plate means having a profiled aperture for interferingly receiving the conductive posts thereby retaining the front shielded portion to the insulative housing, and two legs extending downwardly from the first plate means, each said extending leg being semi-cylindrically formed to face each other to form a substantially cylindrical configuration, and each said extending leg having first retention means to retain said connector to said board.

11. The connector of claim 10 wherein the mounting aperture means comprises a counterbored hole from an underside of said base member.

12. The connector of claim 10 wherein the mounting aperture means comprises standoff ribs extending along an underside of the base thereby placing an end of the hole above the surface of a mountable printed circuit board.

13. The connector of claim 10 further comprising second retention means to retain the retention member to the connector base portion.

14. The connector of claim 13 wherein the first and second retention means are outwardly formed deformations arcuately shaped.

15. The connector of claim 10 wherein the connector housing includes channel means therethrough for receiving the commoning means and placing them in biasing registration with the retention member.

16. A shielded electrical connector which is mountable to a panel and which interconnects a plurality of terminals to a printed circuit board, the connector comprising:

a shielded connector piston which is mountable to the panel from a first side, the shielded portion comprising means for latching the shielded connector portion to the panel, the shielded connector portion further comprising an opening therethrough which is profiled for mounting over an opening in the panel, the shielded connector portion further comprising at least one commoning arm extending through the panel to a second side of the panel;

an insulative connector comprising means to house a plurality of terminals, the insulative connector portion having a forward portion profiled to extend into the opening in the shielded connector portion, the terminals comprising first portions disposed in the forward portion of the insulative connector portion for interconnecting to a matable electrical connector and second portions for interconnecting to the printed circuit board; and retention tab means of conductive material mounted on the insulative housing having means projecting through said printed circuit board for commoning the commoning arm to a ground trace of said printed circuit board, whereby, when the insulative connector is placed against the second side of the panel, the forward portion of the insulative housing projects through the opening in the shielded connector portion which disposes the first terminal portions forward of the first side of the panel, and the at least one commoning arm is disposed against the retention tab means which commons the shield to the retention tab means.

17. The connector of claim 16 wherein the retention tab means includes a stamped and formed plate and the means for commoning the commoning arm to a circuit board trace comprises at least one leg integral with the plate which is profiled for extending through a printed circuit board through hole.

18. The connector of claim 17 wherein the insulative housing includes a channel integral with the housing which extends behind the plate of the retention tab means such that when the shielded connector portion and the insulative connector piston are mated, the commoning arms are located within said channels and resiliently biased against the plate of the commoning tab.

19. The connector of claim 18 wherein the shielded connector piston is molded from plastic material and plated with a conductive material.

* * * * *

UNITED STATES PATENT OFFICE

CERTIFICATE OF CORRECTION

Patent No. 4,721,473 Dated January 26, 1988

Inventor(s) Henry L. DelGuidice and Roger J. Flaherty

It is certified that error appears in the above-identified patent and that said Letters Patent are hereby corrected as shown below:

In column 8, line 20, claim 16, change "piston" to ---portion---.

In column 8, line 61, claim 18, change "piston" to ---portion---.

In column 8, line 65, claim 19, change "piston" to ---portion---.

Signed and Sealed this

Second Day of August, 1988

*Attest:*

DONALD J. QUIGG

*Attesting Officer*

*Commissioner of Patents and Trademarks*